US008622882B2

(12) United States Patent
Nikolov et al.

(10) Patent No.: US 8,622,882 B2
(45) **Date of Patent: *Jan. 7, 2014**

(54) APPARATUS AND METHOD FOR INSERTION OF CAPSULES INTO FILTER TOWS

(75) Inventors: Bogdan Nikolov, Plovdiv (BG); Dimitar Yanchev, Plovdiv (BG)

(73) Assignee: Aiger Group AG, Zug (CH)

( * ) Notice: Subject to any disclaimer, the term of this patent is extended or adjusted under 35 U.S.C. 154(b) by 345 days.

This patent is subject to a terminal disclaimer.

(21) Appl. No.: 12/891,295

(22) Filed: Sep. 27, 2010

(65) Prior Publication Data

US 2012/0077658 A1 Mar. 29, 2012

(51) Int. Cl.
*B31C 99/00* (2009.01)

(52) U.S. Cl.
USPC ..... 493/47; 493/49; 493/50

(58) Field of Classification Search
USPC ..... 493/47, 49, 50; 131/202
See application file for complete search history.

(56) References Cited

U.S. PATENT DOCUMENTS

| | | | |
|---|---|---|---|
| 3,297,038 | A | 1/1967 | Homburger |
| 3,308,600 | A | 3/1967 | Erdmann et al. |
| 3,339,557 | A | 9/1967 | Karalus |
| 3,339,558 | A | 9/1967 | Waterbury |
| 3,366,121 | A | 1/1968 | Carty |
| 3,390,686 | A | 7/1968 | Irby, Jr. et al. |
| 3,420,242 | A | 1/1969 | Boukair |
| 3,424,172 | A | 1/1969 | Neurath et al. |
| 3,428,049 | A | 2/1969 | Leake et al. |
| 3,508,558 | A | 4/1970 | Seyburn |
| 3,513,859 | A | 5/1970 | Carty |
| 3,547,130 | A | 12/1970 | Harlow et al. |
| 3,550,750 | A | 12/1970 | Jackson |
| 3,575,180 | A | 4/1971 | Carty |
| 3,596,665 | A | 8/1971 | Lindgard |
| 3,602,231 | A | 8/1971 | Dock |
| 3,625,228 | A | 12/1971 | Dock |
| 3,635,226 | A | 1/1972 | Horsewell et al. |
| 3,669,128 | A | 6/1972 | Cohen |
| 3,685,521 | A | 8/1972 | Dock |
| 3,797,644 | A | 3/1974 | Shaw |
| 3,818,223 | A | 6/1974 | Gibson et al. |
| 3,915,176 | A | 10/1975 | Heitmann et al. |
| 3,916,914 | A | 11/1975 | Brooks et al. |
| 3,972,335 | A | 8/1976 | Tiggelbeck et al. |

(Continued)

FOREIGN PATENT DOCUMENTS

| | | | |
|---|---|---|---|
| EP | 1702524 | A1 | 9/2006 |
| EP | 1767107 | A1 | 3/2007 |

(Continued)

OTHER PUBLICATIONS

International Search Report corresponding to International Patent Application No. PCT/IB2011/002245 issued Jan. 30, 2012, 2 pgs.

*Primary Examiner* — Thanh Truong
(74) *Attorney, Agent, or Firm* — Maier & Maier, PLLC

(57) ABSTRACT

An apparatus for insertion of capsules into cigarette filter tows is disclosed. The apparatus may include a tow processing unit, a capsule insertion unit and a filter rod making unit. The capsule insertion unit may include a hopper, a capsule presorter, an inlet pipe, a capsule feeder wheel, a capsule insertion wheel, and a tow gathering funnel.

17 Claims, 7 Drawing Sheets

(56) References Cited

U.S. PATENT DOCUMENTS

| | | | | |
|---|---|---|---|---|
| 3,991,773 | A | 11/1976 | Walker | |
| 4,003,387 | A | 1/1977 | Goldstein | |
| 4,033,387 | A | 7/1977 | Nijs et al. | |
| 4,046,153 | A | 9/1977 | Kaye | |
| 4,082,098 | A | 4/1978 | Owens, Jr. | |
| 4,126,141 | A | 11/1978 | Grossman | |
| 4,238,993 | A | 12/1980 | Brand et al. | |
| 4,280,187 | A | 7/1981 | Reuland et al. | |
| 4,281,670 | A | 8/1981 | Heitmann et al. | |
| 4,281,671 | A | 8/1981 | Bynre et al. | |
| 4,284,088 | A | 8/1981 | Brand et al. | |
| 4,291,713 | A | 9/1981 | Frank | |
| 4,474,190 | A | 10/1984 | Brand | |
| 4,574,816 | A | 3/1986 | Rudszinat | |
| 4,593,706 | A * | 6/1986 | Preston et al. | 131/109.1 |
| 4,677,995 | A | 7/1987 | Kallianos et al. | |
| 4,723,559 | A | 2/1988 | Labbe | |
| 4,729,391 | A | 3/1988 | Woods et al. | |
| 4,736,754 | A | 4/1988 | Heitmann et al. | |
| 4,781,203 | A | 11/1988 | La Hue | |
| 4,807,809 | A | 2/1989 | Pryor et al. | |
| 4,811,745 | A | 3/1989 | Cohen et al. | |
| 4,844,100 | A | 7/1989 | Holznagel | |
| 4,848,375 | A | 7/1989 | Patron et al. | |
| 4,850,301 | A | 7/1989 | Greene, Jr. et al. | |
| 4,862,905 | A | 9/1989 | Green, Jr. et al. | |
| 4,865,056 | A | 9/1989 | Tamaoki et al. | |
| 4,878,506 | A | 11/1989 | Pinck et al. | |
| 4,889,144 | A | 12/1989 | Tateno et al. | |
| 4,925,602 | A | 5/1990 | Hill et al. | |
| 4,941,486 | A | 7/1990 | Dube et al. | |
| 5,012,823 | A | 5/1991 | Keritsis et al. | |
| 5,012,829 | A | 5/1991 | Thesing et al. | |
| 5,025,814 | A | 6/1991 | Raker | |
| 5,060,664 | A | 10/1991 | Siems et al. | |
| 5,060,665 | A | 10/1991 | Heitmann | |
| 5,156,169 | A | 10/1992 | Holmes et al. | |
| 5,191,906 | A | 3/1993 | Myracle et al. | |
| 5,220,930 | A | 6/1993 | Gentry | |
| 5,223,185 | A | 6/1993 | Takei et al. | |
| 5,225,277 | A | 7/1993 | Takegawa et al. | |
| 5,271,419 | A | 12/1993 | Arzonico et al. | |
| 5,331,981 | A | 7/1994 | Tamaoki et al. | |
| 5,387,093 | A | 2/1995 | Takei | |
| 5,387,285 | A | 2/1995 | Rivers | |
| 5,476,108 | A | 12/1995 | Dominguez et al. | |
| 5,724,997 | A | 3/1998 | Smith et al. | |
| 6,229,115 | B1 | 5/2001 | Voss et al. | |
| 6,360,751 | B1 | 3/2002 | Fagg et al. | |
| 6,384,359 | B1 | 5/2002 | Belcastro et al. | |
| 6,385,333 | B1 | 5/2002 | Puckett et al. | |
| 6,647,870 | B2 | 11/2003 | Kohno | |
| 6,779,530 | B2 | 8/2004 | Kraker | |
| 6,848,449 | B2 | 2/2005 | Kitao et al. | |
| 6,904,917 | B2 | 6/2005 | Kitao et al. | |
| 7,074,170 | B2 | 7/2006 | Lanier, Jr. et al. | |
| 7,115,085 | B2 | 10/2006 | Deal | |
| 8,186,359 | B2 | 5/2012 | Ademe et al. | |
| 8,303,474 | B2 * | 11/2012 | Iliev et al. | 493/47 |
| 2002/0020420 | A1 | 2/2002 | Xue et al. | |
| 2002/0166563 | A1 | 11/2002 | Jupe et al. | |
| 2003/0098033 | A1 | 5/2003 | Macadam et al. | |
| 2003/0136419 | A1 | 7/2003 | Muller | |
| 2003/0145866 | A1 | 8/2003 | Hartmann | |
| 2003/0178036 | A1 | 9/2003 | Demmer et al. | |
| 2004/0129281 | A1 | 7/2004 | Hancock et al. | |
| 2004/0261807 | A1 | 12/2004 | Dube et al. | |
| 2005/0016556 | A1 | 1/2005 | Ashcraft et al. | |
| 2005/0039764 | A1 | 2/2005 | Barnes et al. | |
| 2005/0054501 | A1 | 3/2005 | Schroder | |
| 2005/0066986 | A1 | 3/2005 | Nestor et al. | |
| 2005/0070409 | A1 | 3/2005 | Deal | |
| 2005/0076929 | A1 | 4/2005 | Fitzgerald et al. | |
| 2005/0103355 | A1 | 5/2005 | Holmes | |
| 2005/0133051 | A1 | 6/2005 | Luan et al. | |
| 2005/0194014 | A1 | 9/2005 | Read, Jr. | |
| 2006/0112964 | A1 | 6/2006 | Jupe et al. | |
| 2006/0144412 | A1 | 7/2006 | Mishra et al. | |
| 2006/0174901 | A1 | 8/2006 | Karles et al. | |
| 2006/0207616 | A1 | 9/2006 | Hapke et al. | |
| 2006/0272655 | A1 | 12/2006 | Thomas et al. | |
| 2006/0272663 | A1 | 12/2006 | Dube et al. | |
| 2006/0293157 | A1 | 12/2006 | Deal | |
| 2007/0012327 | A1 | 1/2007 | Karles et al. | |
| 2007/0068540 | A1 | 3/2007 | Thomas et al. | |
| 2007/0095357 | A1 | 5/2007 | Besso et al. | |
| 2007/0117700 | A1 | 5/2007 | Kushihashi et al. | |
| 2007/0246055 | A1 | 10/2007 | Oglesby | |
| 2008/0029118 | A1 | 2/2008 | Nelson et al. | |
| 2009/0039102 | A1 | 2/2009 | Garthaffner | |
| 2009/0090372 | A1 | 4/2009 | Thomas et al. | |
| 2009/0120449 | A1 | 5/2009 | Tindall | |
| 2009/0145449 | A1 | 6/2009 | Cieslikowski et al. | |
| 2010/0099543 | A1 | 4/2010 | Deal | |

FOREIGN PATENT DOCUMENTS

| | | | |
|---|---|---|---|
| GB | 709203 | | 5/1954 |
| GB | 737329 | | 9/1955 |
| GB | 778044 | | 7/1957 |
| GB | 807404 | | 1/1959 |
| WO | WO 03/009711 | A1 | 2/2003 |
| WO | WO 03/055338 | A2 | 7/2003 |
| WO | WO 2004/047572 | A1 | 6/2004 |
| WO | WO 2004/057986 | A2 | 7/2004 |
| WO | WO 2006/064371 | A1 | 6/2006 |
| WO | WO 2006/136196 | A1 | 12/2006 |
| WO | WO 2006/136197 | A1 | 12/2006 |
| WO | WO 2006/136198 | A1 | 12/2006 |
| WO | WO 2006/136199 | A1 | 12/2006 |
| WO | WO 2007/010407 | A3 | 1/2007 |
| WO | WO 2007/012981 | A2 | 2/2007 |
| WO | WO 2007/012981 | A3 | 2/2007 |
| WO | 2007/038053 | | 4/2007 |
| WO | WO 2007/038053 | A1 | 4/2007 |
| WO | WO 2007/060543 | A2 | 5/2007 |
| WO | WO 2008/012329 | A2 | 1/2008 |
| WO | 2009/071272 | | 6/2009 |
| WO | 2011/083405 | | 7/2011 |

* cited by examiner

APPARATUS AND METHOD FOR INSERTION OF CAPSULES INTO FILTER TOWS

BACKGROUND

Cigarettes and other smoking articles commonly include filter portions (universally known as filter segments) intended to remove some impurities and toxins from the cigarette smoke as it is inhaled. In certain cases, cigarette manufacturers may wish to impart flavor to the cigarette smoke as it is inhaled by the smoker.

One method of imparting flavor to a cigarette may be to include a flavor capsule within the filter portion of a cigarette. When the capsule is ruptured, it releases flavorings or aromatic material into the air stream passing through the filter. These capsules may also alter other chemical or physical characteristics of the inhaled smoke, such as, for example, cooling or moistening the smoke such that the smoker is provided with an enhanced smoking experience.

SUMMARY

An apparatus for insertion of capsules into cigarette filter tows, including a tow processing unit coupled to a capsule insertion unit and a filter rod making unit coupled to the capsule insertion unit, the tow processing unit including a tow bale, a plurality of rollers, a plurality of banding jets and a plasticizer chamber, and the rod making unit including a garniture bed, a sensor and a knife carrier. The capsule insertion unit including a hopper, an in-line presorting device, an inlet pipe, a feeder wheel rotating about an axis of rotation, the feeder wheel including a circular cavity in communication with said inlet pipe, an in-line sensor continuously controlling the quality of the capsules, an insertion wheel in operative communication with the feeder wheel and a tow gathering funnel configured to receive an edge of the insertion wheel.

The feeder wheel includes a plurality of radial channels in communication with the circular cavity of the wheel, each radial channel configured to receive a plurality of capsules and terminating at the outer edge of the feeder wheel, and a stationary cam having a lower edge and a variable height such that the lower edge selectively blocks the apertures along a portion of the circumferential edge of the feeder wheel.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
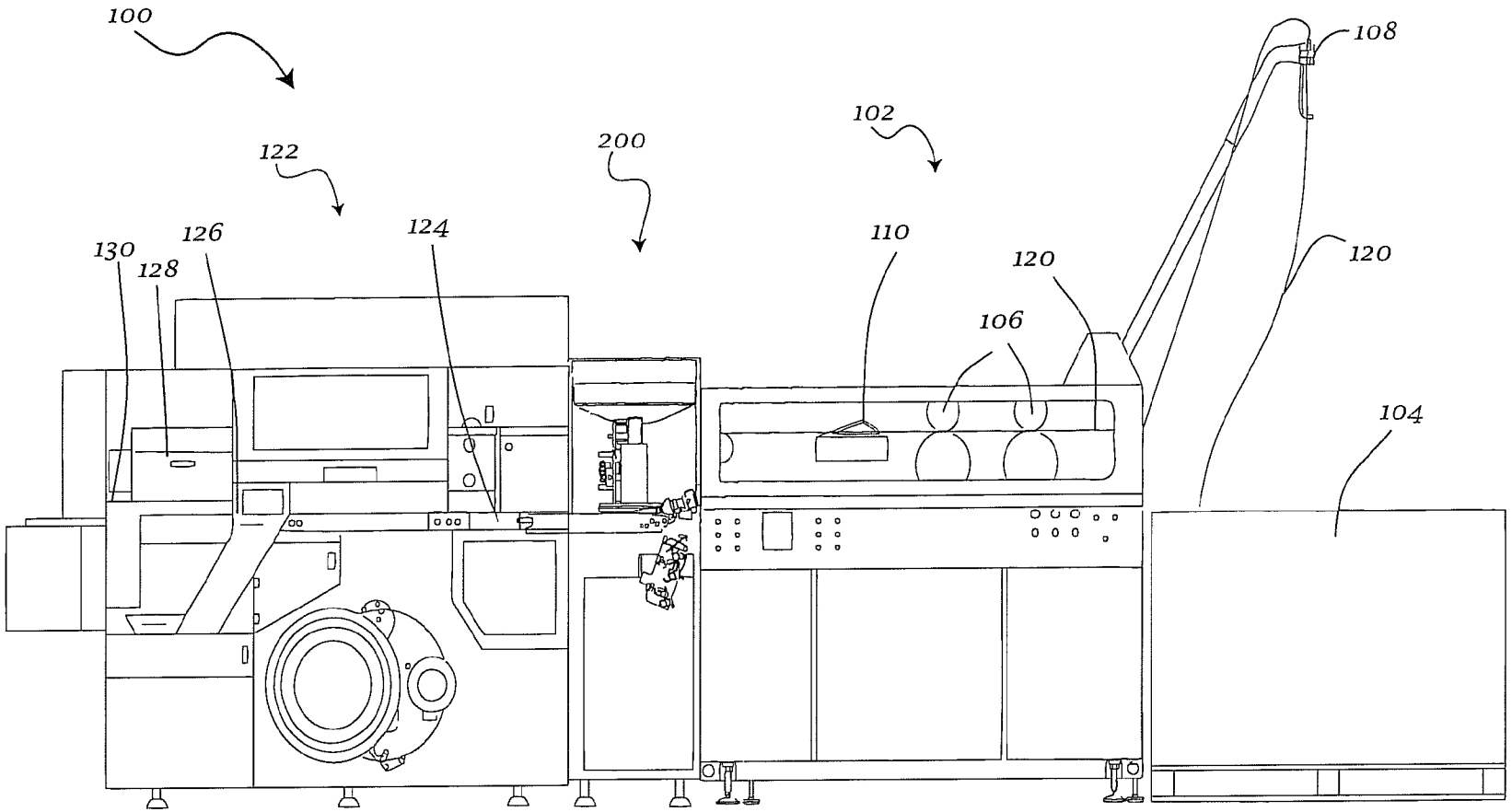
FIG. 1 is an exemplary diagram of an apparatus for insertion of capsules into filter tows.

Turning to FIG. 1, an apparatus for inserting capsules into filter webs 100 is provided. Apparatus 100 may include a tow processor unit 102, a capsule insertion unit 200 and a rod making unit 122. Tow processor unit 102 may include a bale 104, a plurality of rollers 106, a plurality of banding jets 108 and plasticizer chamber 110. Rod making unit 122 may include a garniture bed 124, sensor 126, knife carrier 128 and ejector 130. Filter tow 120 may be withdrawn from bale 104, and directed towards rollers 106 and banding jets 108, which facilitate the expansion and blooming of tow 120 to a desired width. After passing over rollers 106 and banding jets 108, tow 120 may be directed to plasticizer chamber 110, where it may be coated with plasticizer, thereby facilitating swelling of the fibers of tow 120 and imparting greater cohesive properties to tow 120. Upon exiting plasticizer chamber 110, tow 120 may be directed towards capsule insertion unit 200.

Figure 2A:
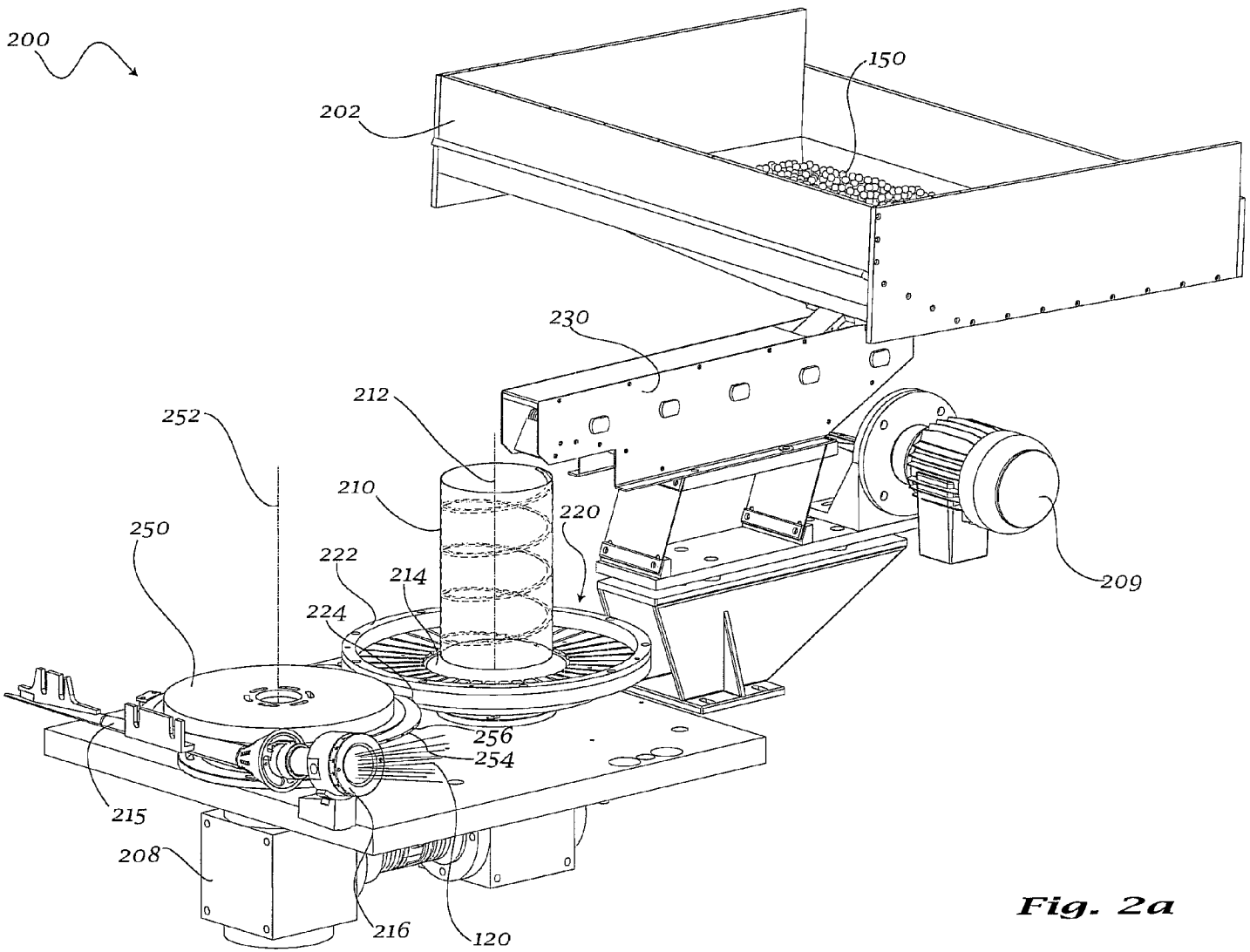
FIG. 2*a* is a view of an exemplary embodiment of a capsule insertion unit.

Turning now to FIG. 2*a*, capsule insertion unit 200 may include a hopper 202, presorting device 230, motors 208, 209, inlet pipe 210, feeder wheel 220, and insertion wheel 250. Capsule insertion unit 200 may also include tow gathering funnel 216 and tongue members 215. Motors 208, 209 may be servomotors or any other motive device known to one having ordinary skill in the art. Hopper 202 may have an opening defined near the bottom thereof. Presorting device 230 may be positioned between hopper 202 and inlet pipe 210, with one end of presorting device 230 being positioned substantially below the bottom opening of hopper 202, and the other end of presorting device 230 being positioned substantially above inlet pipe 210. Inlet pipe 210 may be positioned above feeder wheel 220. Feeder wheel 220 may rotate around an axis of rotation 212 and may be disposed such that axis of rotation 212 is substantially vertical. Feeder wheel 220 may have a circular cavity 214 defined therein such that cavity 214 is concentric with feeder wheel 220. Feeder wheel 220 may further include a stationary ring 222 disposed substantially around the circumference of feeder wheel 220. The inner circumference of stationary ring 222 may be substantially the same as the circumference of feeder wheel 220. Stationary ring 222 may include a slit 224 defined in the outer circumferential edge thereof. Inlet pipe 210 may be positioned such that it is substantially coaxial with axis of rotation 212 and such that inlet pipe 210 is in communication with circular cavity 214. Insertion wheel 250 may revolve around an axis of rotation 252, and may be positioned such that axis of rotation 252 is substantially vertical. Insertion wheel 250 may include a thin disc 253 around the periphery thereof, thin disc 253 having a circumferential edge 254 with a plurality of recesses 256 defined therein. Each of recesses 256 may be sized to accept a single capsule 150, and thin disc 253 may have a thickness substantially similar to, or smaller than, the diameter of a single capsule 150. Circumferential edge 254 may further be sized so as to allow circumferential edge 254 to be received within slit 224 of stationary ring 222 of feeder wheel 220, where circumferential edge 224 may interface with feeder wheel 220. Capsules 150 may therefore pass from hopper 202 and through presorting device 230, into inlet pipe 210 and thereafter into cavity 214 of feeder wheel 220. Subsequently, capsules 150 may pass from feeder wheel 220 to insertion wheel 250, substantially as described below.

Some embodiments of capsule insertion unit 200 may include at least one transfer wheel (not shown) disposed between feeder wheel 220 and insertion wheel 250. The transfer wheels may serve to transfer capsules from feeder wheel 220 to insertion wheel 250 in embodiments of unit 200 where the distance between presorting device 230 and tow gathering funnel 216 is greater than the sum of the radius of feeder wheel 220 and the diameter of insertion wheel 250. In such embodiments, any desired number of transfer wheels may be used; capsule insertion unit 200 may thus be adaptable for apparatuses of having diverse sizes and configurations. The configuration and structure of the transfer wheel may be substantially similar to the configuration and structure of insertion wheel 200. The interactions between the transfer wheel and the insertion wheel, the transfer wheel and the feeder wheel, and any two transfer wheels may be substantially similar to the interactions between the feeder wheel and the insertion wheel, as described herein.

Figure 2B:
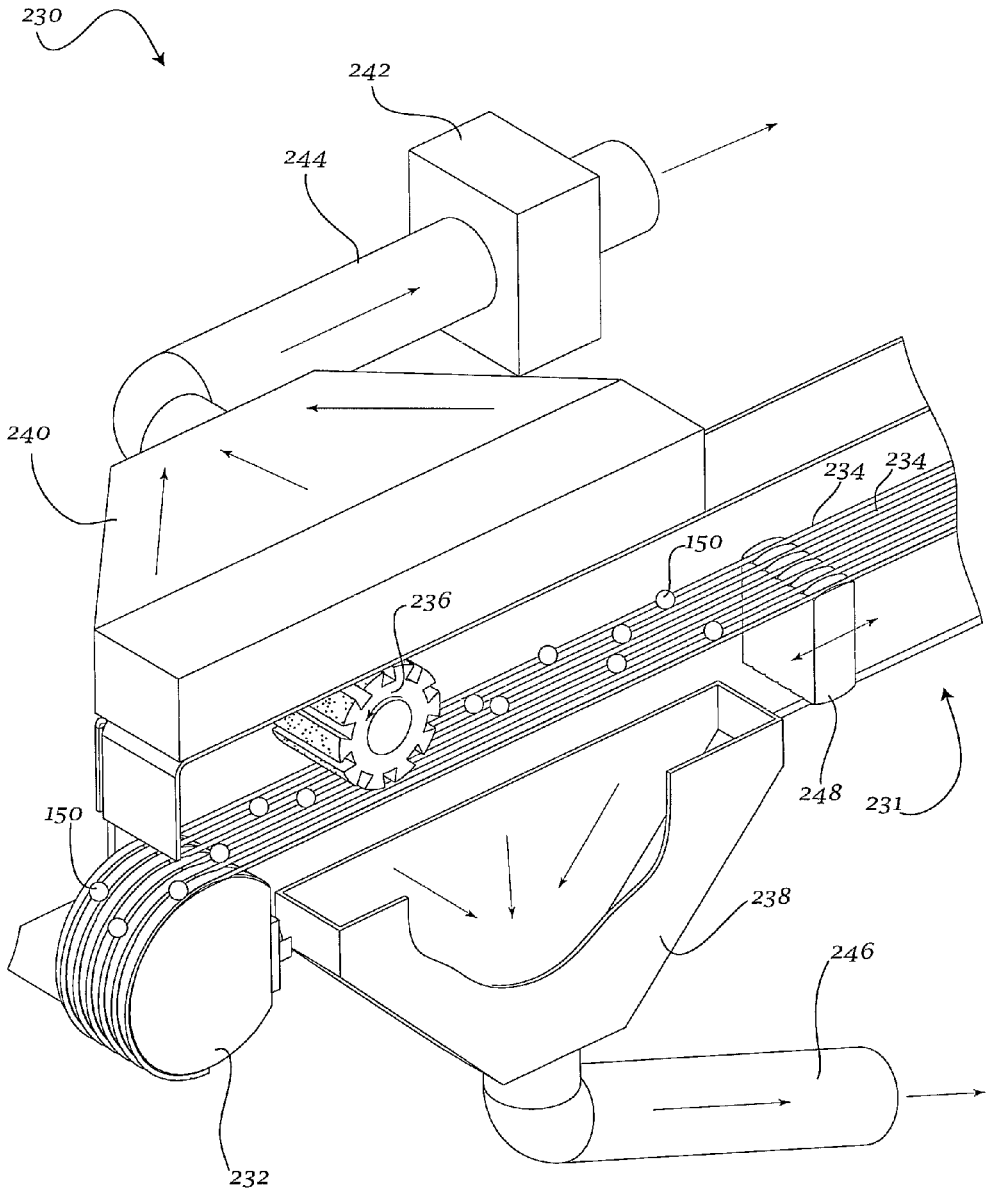
FIG. 2*b* is a view of an exemplary embodiment of a capsule presorting device.

Turning to FIG. 2*b*, an exemplary embodiment of a capsule presorting device 230 is provided. Presorting device 230 may include a vibrating thread transporter 231, a roller 232, a plurality of transport threads 234, a rotating brush 236, at least two aspiration devices 238, 240, a control device 242, at least two extraction pipes 244, 246, and a vibrating device 248. Transport threads 234 may be positioned such that gaps between any two of the plurality of transport threads 234 are created. The gap between transport threads 234 may be sized to facilitate transporting capsules 150 that meet the desired capsule size standards through presorting device 230 while facilitating the removal of smaller or irregularly-shaped capsules. Vibrating device 248 may facilitate the movement of capsules 150 through presorting device 230 while further facilitating the removal of smaller or irregularly-sized capsules by imparting vibrational motion to threads 234. Smaller or irregularly-sized capsules may therefore fall through the gaps between threads 234 into bottom aspirating device 238, and removed via bottom extraction pipe 246. Rotating brush 236 may be positioned such that the axis of rotation of rotating brush 236 is substantially perpendicular to threads 234 and may rotate in the opposite direction of the motion of capsules 150. Brush 236 may facilitate removing dust from capsules 150 that may have accumulated during the manufacturing process and may also facilitate the removal of capsules having a lower capsule mass than desired. Capsules with mass that is lower than the desired mass may not pass under the brush and are consequently sucked into upper aspiration device 240 and removed via top extraction pipe 244. Control device 242 may adjust the amount of negative air pressure through top aspiration device 236, thereby allowing the user to control the upper limit of the mass of the capsules that are removed via top aspiration device 236. Consequently, capsules 150 that meet the desired size, shape and mass standards may pass towards roller 232, where they may exit presorting device 230 and may fall or be placed onto endless belt 204.

Figure 3A:
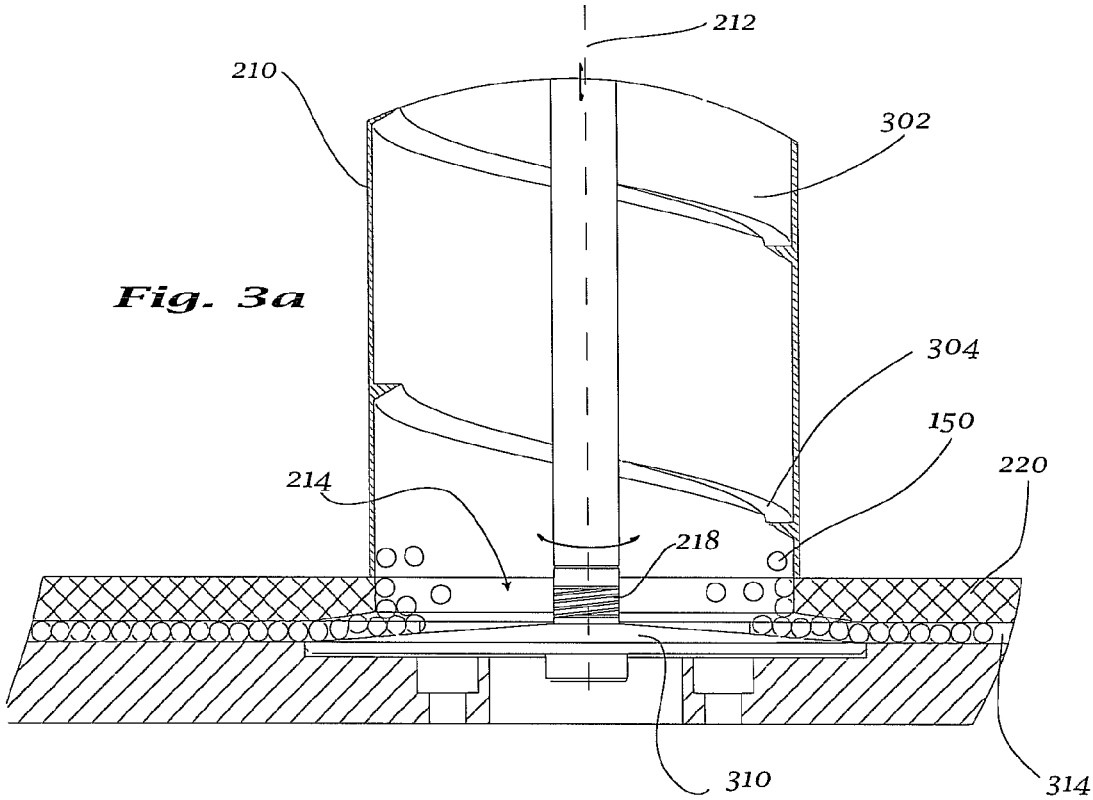
FIG. 3*a* is a cross-section of an exemplary embodiment of a capsule insertion unit.
Figure 3B:
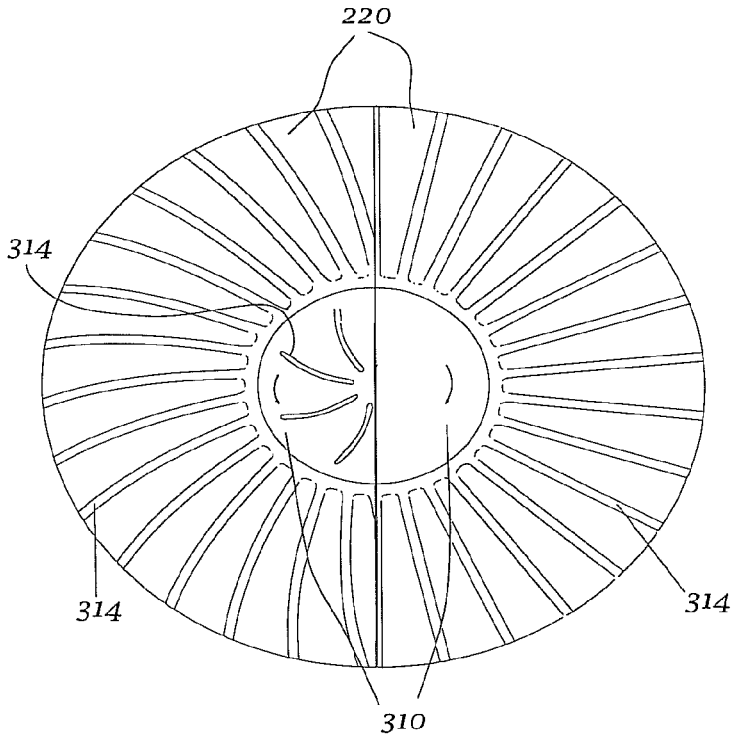
FIG. 3*b* is a diagram of an exemplary embodiment of a feeder wheel and a distribution disk of a capsule insertion unit.

Turning to FIGS. 3*a*-3*b*, inlet pipe 210 may be substantially cylindrical and include a cavity 302 defined by the inner surface of inlet pipe 210. Inlet pipe 210 may also have a spiral ramp 304 disposed within cavity 302. Spiral ramp 304 may be adjacent to the inner surface of inlet pipe 210 and may have a substantially downward slope. Spiral ramp 304 may be configured to direct capsules 150 from the top of tube 210 to the bottom of tube 210.

Disposed substantially horizontally within circular cavity 214 of, and concentric to feeder wheel 220 may be distribution disk 310. Distribution disk 310 may include an axle 216. Axle 216 may be positioned substantially coaxial to axis of rotation 212 and may include a spring 218 disposed therein. Capsules 150 exiting from inlet pipe 210 may collect within circular cavity 214 and on the top surface of distribution disk 310. The elevation of distribution disk 310 within circular cavity 214 may be automatically adjusted depending on the quantity of capsules 150 present on the top surface of distribution disk 310 to facilitate smooth transfer of capsules from distribution disk 310 to feeder wheel 220. Distribution disk 310 may oscillate around axis of rotation 212, and may have an oscillation range of approximately ±180°. The top surface of distribution disk 310 may be flat or may have grooves 312 defined therein. The oscillating action and grooves 312 of distribution disk 310 may likewise facilitate supplying capsules 150 to feeder wheel 220.

The oscillation of distribution disk 310 may be facilitated by spring 218. The rotation of feeder wheel 220 around axis of rotation 212 may impart rotational motion to distribution disk 310 via frictional contact between feeder wheel 220 and distribution disk 310. As distribution disk 310 begins to rotate with feeder wheel 220, spring 218 may be imparted with increasing tension. As spring 218 reaches its limit of tension, it may decompress, thereby returning distribution disk 310 to its original position. The repetition of this motion may thus cause distribution disk to oscillate, thereby facilitating the movement of capsules 150 towards the edges of distribution disk 310 and into feeder wheel 220.

Feeder wheel 220 may include radial channels 314 defined in the interior thereof. Radial channels 314 may extend from circular cavity 214 towards the periphery of feeder wheel 220. Radial channels 314 may have a linear or arcuate profile; the particular profile may be chosen depending on the shape of capsules 150 used in a particular application and the speed with which capsules 150 pass through radial channels 314. Capsules 150 may pass from distribution disk 310 into radial channels 314 of feeder wheel 220. The rotation of feeder wheel 220 around axis of rotation 212 provides centrifugal force to facilitate maintenance of capsules 150 within radial channels 314 as well as the movement of capsules 150 from circular cavity 214 to the outer edge of feeder wheel 220 via radial channels 314.

Figure 4:
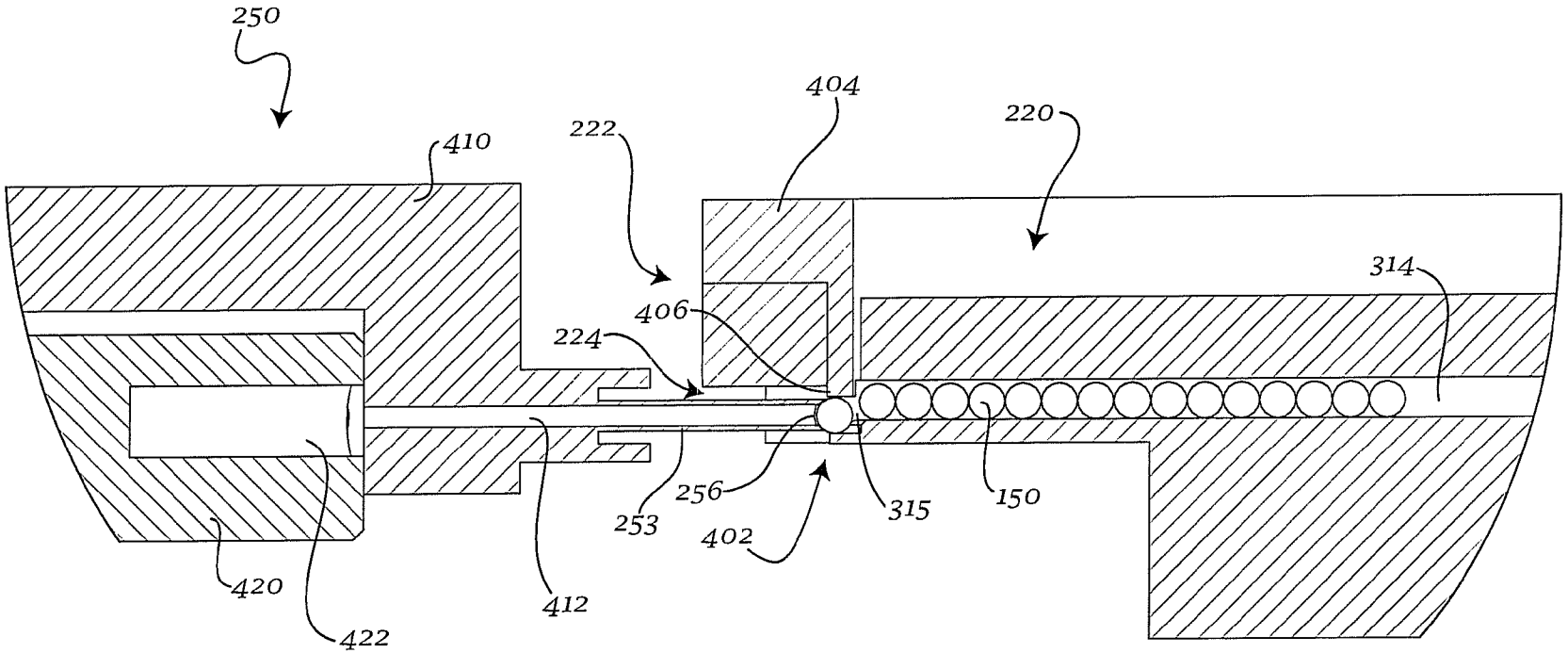
FIG. 4 is a cross-section detail of exemplary embodiments of a feeder wheel and an insertion wheel.

FIG. 4 shows a cross-section view of feeder wheel 220 and insertion wheel 250 at the point where insertion wheel 250 is received within slit 224 of stationary ring 222. In the cross-section view, the circumferential edges of feeder wheel 220 and insertion wheel 250 are substantially tangential to, and in contact with each other, thereby defining an interface locus 402 at the tangent location. Stationary ring 222 may be disposed substantially above interface locus 402 and may include a stationary cam 404. Each radial channel 314 may terminate at an aperture 315 disposed on the circumferential edge of feeder wheel 220. Stationary cam 404 may facilitate separating a single capsule 150 from the sequence of capsules 150 disposed within a radial channel 314. Stationary cam 404 may include a lower edge 406 that is disposed proximate to the circumferential edge such that apertures 315 are partially blocked by lower edge 406. However, proximate to, and prior to interface locus 402, the profile of stationary cam 402 may be altered such that lower edge 406 no longer blocks an aperture 315 that is about to approach interface locus 402. At that point, a capsule 150 may pass from radial channel 314 into aperture 315. The point at which a capsule 150 passes into aperture 315 may be positioned such that a capsule 150 is disposed within aperture 315 when the particular aperture 315 is located at interface locus 402. Subsequent to interface locus 402, the profile of stationary cam 404 may be such that lower edge 406 again blocks aperture 315. (It should be noted that the terms "prior to" and "subsequent to" as used in this paragraph should be understood as having reference to the direction of travel of feeder wheel 220).

Insertion wheel 250 may include a rotating portion 410 and an inner portion 420. Rotating portion 410 may include thin disc 253, which may have a circumferential edge 254 with a plurality of recesses 256 defined therein. Thin disc 253 may further have a plurality of vacuum channels 412 defined therein, each vacuum channel 412 extending from the inner edge of rotating portion 410 to a corresponding recess 256 on the circumferential edge of thin disc 253 such that each vacuum channel 412 is in communication with a corresponding recess 256. Inner portion 420 may have a vacuum chamber 422 denied therein, the vacuum chamber 422 being in communication with vacuum channels 412. Thus, as negative air pressure is applied to vacuum chamber 422, the negative air pressure may likewise applied to recesses 256. At interface locus 402, such negative air pressure may facilitate transferring a capsule 150 from an aperture 314 to a recess 256. Subsequently, such negative air pressure may facilitate maintaining capsule 150 within recess 256 while rotating portion 410 of insertion wheel 250 is in motion.

Figure 5:
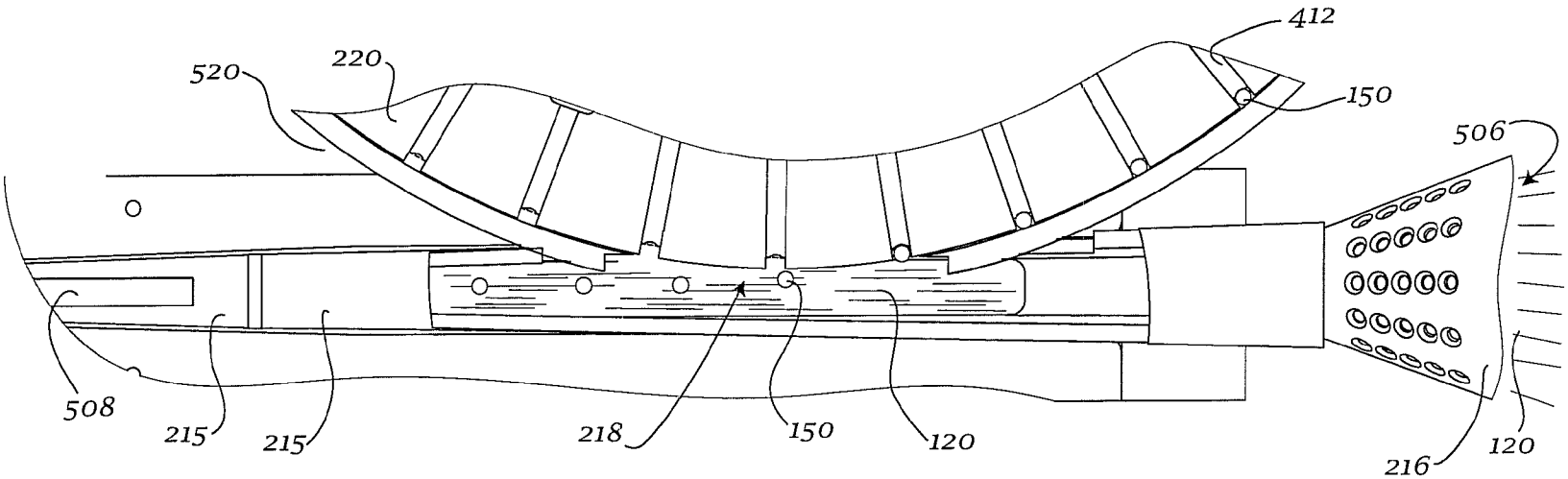
FIG. 5 is a view of an exemplary embodiment of an insertion wheel of a capsule insertion unit operatively engaged with an exemplary embodiment of a tow gathering funnel of a capsule insertion unit.

Turning to FIG. 5, circumferential edge 254 of thin disc 253 of insertion wheel 250 may be received in slit 218 of tow gathering funnel 216. Tow gathering funnel 216 may include tongues 215, inlet aperture 506 and outlet aperture 508. Tow 120 may be drawn into tow gathering funnel 216 via inlet aperture 506. Within tow gathering funnel 216, tow 120 may be compacted by tongues 215 such that tow 120 exits through outlet aperture 508 having a substantially rod-like shape. As tow 120 passes through tow gathering funnel 216, capsules 150 pass from recesses 256 of insertion wheel 220 into tow gathering funnel 216. The transfer of capsules from recesses 256 into filter tow 120 is facilitated by the centrifugal force generated by the rotation of insertion wheel 250. The transfer of capsules 150 from recesses 256 into filter tow 120 may be such that the motion vector of capsules 150 may be substantially horizontal. Tongues 215 may further facilitate the transfer of a capsule 150 from the insertion wheel 250 into the tow 120. Tongues 215 may also facilitate the precise support and positioning of capsules in tow 120. As capsules enter tow 120, tongues 215 may facilitate precisely positioning capsules 150 at the desired position within tow 120.

The thickness of thin disc 253 may be adjusted as desired based on the desired size of capsules 150. The thickness of thin disc 253 may be similar to or less than the diameter of a capsule 150. The operator may replace a particular thin disc 253 with a thin disc 253 having a different thickness, depending on the size of the capsule that is to be used with capsule insertion unit 200. For example, for capsules having a diameter of approximately 3.5 millimeters (mm), a thin disk having a thickness of approximately 3.00 mm may be used. For capsules having a diameter of approximately 3.7 mm, a thin disk having a thickness of approximately 3.05 mm may be used. Other thicknesses of thin disk 253 may be used or contemplated as desired.

The low thickness of thin disc 253 and the shape of tongues 215 may facilitate the precise positioning of capsules 150 in filter tow 120 substantially proximate to the point where filter tow 120 is shaped into the final rod-like shape and wrapped by a tow net. The proximity of the point where the capsules are inserted into tow 120 and the point where tow 120 is shaped into the final rod like shape may reduce the necessity for any additional structure that facilitate positioning of capsules 150 within tow 120, thereby simplifying the configuration of insertion unit 200 and reducing the amount of components therein.

The motion of tow 120 and the rotation of insertion wheel 250 may be synchronized such that the linear speed of tow 120 may be substantially equal to the tangential speed of insertion wheel 250. Such synchronization facilitates the insertion of capsules 150 into tow 120 at equal intervals, thereby allowing capsules 150 to be equally spaced relative to each other. The tow may be simultaneously shaped into a substantially rod-like configuration by tongues 215. Consequently, when tow 120 exits through tow outlet aperture 508, capsules 150 are embedded at the desired regular intervals within tow 120.

Figure 6:
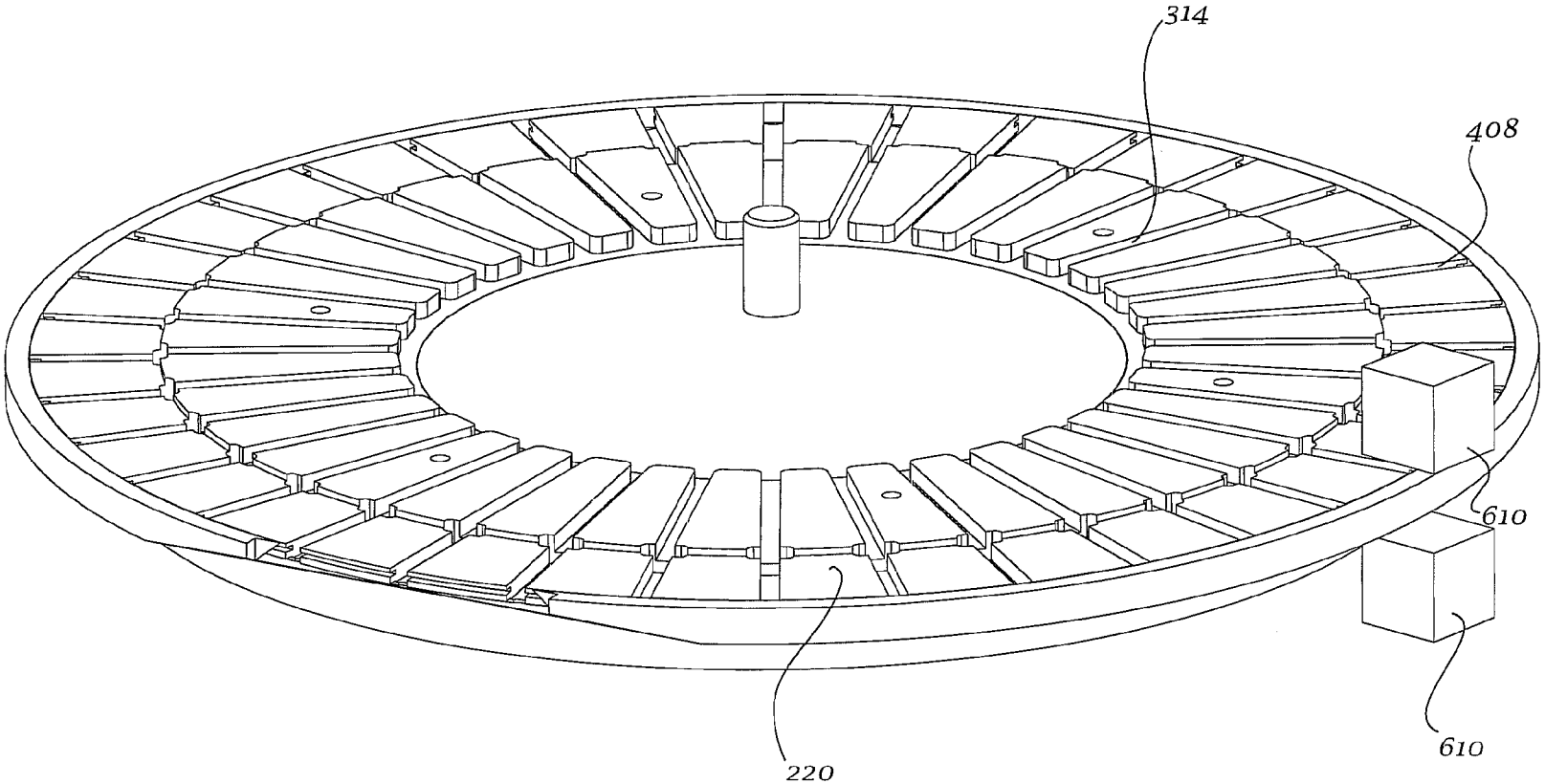
FIG. 6 is a view of an exemplary embodiment of a capsule quality sensor.

Turning to FIG. 6, feeder wheel 220 may also include at least one sensor 610. Sensor 610 may measure the quality of the capsules disposed within feeder wheel 220 prior to insertion. At least one sensor 610 may include an optical sensor, a laser sensor, a microwave sensor, an induction sensor, a capacitive sensor, or any other sensor known to one having ordinary skill in the art. At least one sensor 610 may also include a video camera. Capsules that do not meet desired quality standards may then be ejected from feeder wheel 220.

In operation, capsules 150 may be stored in hopper 202 and be withdrawn there from by presorting device 230, as shown in FIGS. 2*a*-2*b*. Capsules 150 may have a diameter between approximately 0.5 mm and approximately 8 mm, and may have a spherical, elliptical, irregular, or any other desired shape. Capsules 150 may also be filled with a liquid or any other desired substance. Presorting device 230 may remove dust from capsules 150 and may also remove any capsule fragments, empty capsules, irregularly shaped capsules and any other capsules that do not meet desired quality standards. Upon exiting presorting device 230, capsules 150 may be deposited via spiral ramp 304 disposed within cavity 302 of inlet pipe 206 into circular cavity 214 of feeder wheel 220, as shown in FIG. 3*a*. Capsules 150 may thus be deposited onto the top surface of distribution disk 310, which is disposed within circular cavity 214. As distribution disk 310 oscillates around axis of rotation 212, capsules 150 are driven from distribution disk 310 into radial channels 314 of feeder wheel 220. Feeder wheel 220 may be driven by motor 208 and rotate around axis of rotation 212. As feeder wheel 220 rotates, capsules 150 may be driven through radial channels 314 by the centrifugal force generated from the rotation of feeder wheel 220. During the rotation of the insertion disk 220, the capsules 150 pass through sensor 610, which may determine the quality of capsules 150 and may eject any capsules not meeting desired quality standards. While a particular radial channel 314 is not in proximity to interface locus 402, lower edge 406 of stationary cam 404 may be located in a lower position, reducing the likelihood of capsules 150 passing from radial channel 314 into aperture 315. As a particular radial channel 314 approaches interface locus 402, lower edge 406 of stationary cam 404 may be in a higher position, thereby allowing a capsule 150 to pass from radial channel 314 into aperture 315. As a radial channel 314 departs from interface locus 402, lower edge 406 of stationary cam 404 may once again be in a lower position, thereby reducing the likelihood of remaining capsules 150 passing from radial channel 314 into aperture 315.

At interface locus 402, a capsule may be transferred from aperture 315 into a recess 256 that is disposed on circumferential edge 254 of thin disc 253 of insertion wheel 250. Negative air pressure applied to aperture 315 via vacuum channel 412 may facilitate the transfer of capsule 150 from aperture 315 into recess 256. As an recess 256 departs from interface locus 402, the negative pressure applied thereto may facilitate maintaining capsule 150 within recess 256. Capsule 150 may then be carried by insertion wheel 250 towards tow gathering funnel 216. When a particular recess 256 is disposed within slit 218 of tow gathering funnel 216, a capsule 150 may pass from recess 256 into tow 120, as shown in FIG. 5. Negative air pressure may also cease to be applied to the recess 256, so as to facilitate the transfer of capsule 150 into tow 120. Capsule 150 may be transferred into tow 120 such that the motion vector of capsule 150 is substantially horizontal. Tongues 215 may then adjust the position of capsule 150 within tow 120 so that capsule 150 is placed in the desired position within tow 120. As tow 120 exits tow gathering funnel 216, tongues 215 facilitate the formation of tow 120 into a substantially rod-like configuration.

Turning back to FIG. 1, filter tow 120 with capsules 150 disposed at regular intervals therein may then exit capsule insertion unit 200 and be directed to rod making unit 122. Tow 120 may then be deposited on garniture bed 124 wherein it may be formed into a continuous filter rod. The continuous filter rod may then be directed towards sensor 126 and knife carrier 128, where the continuous filter rod may be cut into individual filter portions by knives (not shown) within knife carrier 128. The individual filter portions may be evaluated by sensor 126 and filter portions that do not conform to desired specifications may be discarded via ejector 130.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An apparatus for insertion of capsules into cigarette filter tows, comprising:

a tow processing unit coupled to a capsule insertion unit and a filter rod making unit coupled to the capsule insertion unit, the tow processing unit further comprising a tow bale, a plurality of rollers, a plurality of handing jets and a plasticizer chamber;

the capsule insertion unit further comprising a hopper, a presorting unit, an inlet pipe, a feeder wheel, the feeder wheel further comprising a circular cavity in communication with the inlet pipe and a distribution disk disposed within the cavity, an insertion wheel in operative communication with the feeder wheel, and a tow gathering funnel configured to receive an edge of the insertion wheel; and the rod making unit further comprising a garniture bed, a sensor, a knife carrier and an ejector wherein said presorting unit further comprises a vibrating mechanism;

a plurality of transport threads;

a rotating brush having an axis of rotation perpendicular to the direction of said transport threads;

at least two aspiration devices configured to provide negative air pressure and coupled to extraction pipes; and a control unit for varying the amount of negative air pressure supplied to at least one of said at least two aspiration devices.

2. The apparatus of claim 1, wherein the feeder wheel further comprises:

at least one capsule quality sensor;

a plurality of radial channels in communication with said circular cavity, each of said radial channels configured to receive a plurality of capsules and terminating at an aperture at the circumferential edge of the feeder wheel; and a stationary cam having a lower edge and a variable height such that the lower edge selectively blocks the apertures along a portion of the circumferential edge of the feeder wheel.

3. The apparatus of claim 2, wherein said radial channels have a linear shape.

4. The apparatus of claim 2, wherein said radial channels have an arcuate shape.

5. The apparatus of claim 2, wherein the at least one capsule quality sensor further comprises a microwave sensor.

6. The apparatus of claim 2, wherein the at least one capsule quality sensor further comprises an optical sensor.

7. The apparatus of claim 2, wherein the at least one capsule quality sensor further comprises a laser sensor.

8. The apparatus of claim 2, wherein the at least one capsule quality sensor further comprises an inductive sensor.

9. The apparatus of claim 2, wherein the at least one capsule quality sensor further comprises a capacitive sensor.

10. The apparatus of claim 2, wherein the at least one capsule quality sensor further comprises a video camera.

11. The apparatus of claim 1, wherein the insertion wheel further comprises:

a rotating portion having a disc defined around the periphery of the rotating portion;

a plurality of recesses defined in the circumferential edge of the disc;

a plurality of vacuum channels, each vacuum channel having a first end in communication with a corresponding recess and second end in communication with a vacuum chamber defined in the inner portion of the insertion wheel.

12. The apparatus of claim 11, wherein the thickness of the disc is substantially similar to the diameter of a capsule.

13. The apparatus of claim 11, wherein the thickness of the disc is less than the diameter of a capsule.

14. The apparatus of claim 11, wherein the thickness of the disc is approximately 3.00 millimeters.

15. The apparatus of claim 11, wherein the thickness of the disc is approximately 3.05 millimeters.

16. The apparatus of claim 1, wherein said tow gathering funnel further comprises at least one tongue member adapted to position a capsule within the filter tow.

17. The apparatus of claim 1, wherein the capsules have a diameter between approximately 0.5 mm and approximately 8 mm.

* * * * *